US005979330A

United States Patent [19]

Cornell

[11] Patent Number: 5,979,330

[45] Date of Patent: Nov. 9, 1999

[54] INTEGRATED ONE-PIECE PLASTIC SHOTSHELL WAD

[76] Inventor: John S. Cornell, 100 Wolf Pit Ave., Norwalk, Conn. 06851

[21] Appl. No.: 09/012,315

[22] Filed: Jan. 23, 1998

[51] Int. Cl.[6] ..... F42B 7/08

[52] U.S. Cl. ..... 102/451; 102/449; 102/532

[58] Field of Search ..... 102/448–463, 102/532

[56] References Cited

U.S. PATENT DOCUMENTS

| | | | |
|---|---|---|---|
| D. 324,806 | 3/1992 | Cole . | |
| 3,469,527 | 9/1969 | Pace | 102/451 |
| 3,487,779 | 1/1970 | Hendricks | 102/453 |
| 3,565,010 | 2/1971 | Sahlmann et al. . | |
| 3,568,603 | 3/1971 | Vartanian | 102/453 |
| 3,623,431 | 11/1971 | Hendricks | 102/450 |
| 3,653,326 | 4/1972 | Howson et al. | 102/451 |
| 3,662,683 | 5/1972 | Merritt . | |
| 3,670,650 | 6/1972 | McCaffrey et al. . | |
| 3,707,915 | 1/1973 | Kerzman | 102/451 |
| 3,722,420 | 3/1973 | Herter . | |
| 3,726,231 | 4/1973 | Kelly et al. . | |
| 3,786,753 | 1/1974 | Eckstein et al. . | |
| 3,788,224 | 1/1974 | Merritt . | |
| 3,796,157 | 3/1974 | Anderson | 102/451 |
| 3,812,784 | 5/1974 | Herter . | |
| 3,974,770 | 8/1976 | Clark, Jr. . | |
| 4,103,621 | 8/1978 | Fackler . | |
| 4,151,799 | 5/1979 | Jackson . | |
| 4,220,090 | 9/1980 | Fackler . | |
| 4,291,625 | 9/1981 | Stagg, Jr. . | |
| 4,295,426 | 10/1981 | Genco et al. . | |
| 4,574,701 | 3/1986 | Fiocchi . | |
| 4,615,255 | 10/1986 | Carter . | |
| 4,864,934 | 9/1989 | Theising . | |
| 5,413,050 | 5/1995 | Maki . | |

FOREIGN PATENT DOCUMENTS

| | | | |
|---|---|---|---|
| 1454931 | 10/1966 | France | 102/454 |
| 1580469 | 9/1969 | France | 102/448 |
| 2571132 | 4/1986 | France | 102/448 |
| 2018748 | 11/1970 | Germany | 102/449 |
| 1124236 | 8/1968 | United Kingdom | 102/448 |

*Primary Examiner*—Harold J. Tudor

*Attorney, Agent, or Firm*—St. Onge Steward Johnston & Reens LLC

[57] ABSTRACT

A shotshell wad for use in a shotgun shell is provided. Three discs are disposed within a generally cylindrical tubular wall, and define a gas seal section, a middle section, a shot cup extension section, and a shot cup section. The third disc, which separates the shot cup extension section and the shot cup section, is detachably connected to the tubular wall such that when the shotshell is fired, the third disc breaks away and travels rearward relative to the rest of the shotshell wad to a position adjacent to the second disc. A plurality of fingers are defined by a plurality of lateral cuts through the tubular wall in the shot cup section extending from a point in the shot cup section to the forward end of the tubular wall. The tubular wall also includes a plurality of circumferential cuts passing therethrough substantially at the point where the plurality of lateral cuts terminate. The plurality of circumferential cuts extending through a section of each of the plurality of fingers. A plurality of lateral ridges extend inwardly from the tubular wall from substantially the point where the plurality of lateral cuts terminate to substantially the forward end of the tubular wall and are positioned at substantially the center of each of the plurality of fingers.

20 Claims, 7 Drawing Sheets

INTEGRATED ONE-PIECE PLASTIC SHOTSHELL WAD

FIELD OF THE INVENTION

The present invention relates to shotshells, and more particularly to plastic wads for use with shotshells.

BACKGROUND OF THE INVENTION

Modern shotgun shells (frequently referred to as shotshells) are made up of five basic components: a case (the overall packaging), a primer, powder, a wad (or wad column) and shot. The case is made up of brass (otherwise referred to as the "head" of the shotshell), a base wad, and a tube or wall. The primer is seated in the primer pocket. Powder is poured into the tube on top of the base wad and a plastic wad is pressed down on top of the powder within the tube. The shot charge is then poured into the wad cup. Finally, the top of the shell tube is creased and crimped down tightly on top of the shot charge by the machinery loading the shot shells.

To fire the shotgun, a loaded shotshell is placed in the chamber. The trigger is pulled and the firing pin strikes the primer in the shotshell. The primer detonates, igniting the powder charge. The rapidly expanding gases generated by the explosion of the powder charge strike the wad with its load of shot in the shot cup with a blow equal to approximately 12,000 pounds per square inch. The wad, being lighter than the shot, is driven forward into the column of shot nestled in the shot cup.

At this point, undesirable things happen when known wads are being used. The shot charge is, in effect, driven into the floor and the immediately adjacent sides of the shot cup with tremendous force. When the shell is loaded with lead shot, the whole band of shot at the back of the shot column becomes deformed either by contact with other shot or with the steel sides of the chamber of the shotgun barrel. Upon eventually exiting the barrel, these deformed shot fly off (hence the name "flyers") at strange angles, none of which is in the direction of the target. With steel shot, the deformation of pellets is greatly reduced, but still occurs. Perhaps more important is the fact that the steel pellets at the back of the shot column, in effect, beat on the walls of the chamber of the barrel like dozens of ballpeen hammers, a situation that could cause a flawed barrel, or one that has simply been worn out by repeated blows. A further problem is that when the shot cup is driven into the shot column, the recoil force is transferred to the shoulder of the shooter. Because, in known wad designs, the shot cup floor hits the shot column with a tremendous force, the recoil felt by the shooter is a sudden, sharp blow.

The shot exits the chamber into what is known as the forcing cone. This is a section of barrel that tapers from the diameter of the chamber down to the effective diameter of the barrel for most of its length. At this point, more undesirable things happen when known wads are being used. The shot charge stretches out and some of the shot escapes from the wad cup. As this occurs, much of the escaped shot can come in direct contact with the inside of the barrel, causing wear on the barrel with both types of shot, and coating the interior of the barrel with lead when lead shot is used. Another problem with the shot directly contacting the inside of the barrel is that friction is generated between the shot and the barrel, which in turn causes the shot to lose velocity. The same sequence of events occur as the wad and shot charge approach the muzzle of the barrel where they are again constricted, this time by the choke at the muzzle, which is intended to regulate the size of the pattern the shot achieves upon leaving the barrel.

Now the wad and the shot charge exit the barrel. At this point it is important to rapidly separate the shot charge from the wad, so that the wad cannot interfere with the shot pattern. Not only must the wad be quickly slowed, but it must be done so in a manner such that the wad does not spin out of control, interfering with shot proximate to, or even still contained within, the wad. Known designs do not adequately achieve this. The wad often travels up to forty yards downrange, which is approximately two-thirds of the expected range of the shot. Moreover, known wads can deliver only approximately two-thirds of the shot charge on target in a useful pattern.

What is desired, therefore, is a shotshell wad which results in few flyers, which reduces damage to the chamber of the barrel upon firing, which reduces the recoil felt by the shooter upon firing, which inhibits the shot from escaping the shot cup and directly contacting the inside of the barrel, which is quickly separated from the shot upon exiting the barrel, and which delivers the shot charge on target in a useful pattern.

SUMMARY OF THE INVENTION

Accordingly, it is an object of the present invention to provide a shotshell wad which results in few flyers.

Another object of the present invention is to provide a shotshell wad having the above characteristics and which reduces damage to the chamber of the barrel upon firing.

A further object of the present invention is to provide a shotshell wad having the above characteristics and which reduces the recoil felt by the shooter upon firing.

Still another object of the present invention is to provide a shotshell wad having the above characteristics and which inhibits the shot from escaping the shot cup and directly contacting the inside of the barrel.

Yet a further object of the present invention is to provide a shotshell wad having the above characteristics and which is quickly separated from the shot upon exiting the barrel.

Still a further object of the present invention is to provide a shotshell wad having the above characteristics and which delivers the shot charge on target in a useful pattern.

These and other objects of the present invention are achieved by provision of a shotshell wad having a generally cylindrical tubular wall with a rearward end and a forward end. A first disc is disposed within the tubular wall, with the first disc and tubular wall defining a gas seal section proximate to the rearward end of the tubular wall. A second disc is also disposed within the tubular wall between the first disc and the forward end of the tubular wall. The second disc, first disc, and tubular wall define a middle section adjacent to the gas seal section. A third disc is disposed within and detachably connected to the tubular wall between the second disc and the forward end of the tubular wall. The third disc, second disc, and tubular wall define a shot cup extension section adjacent to the middle section and the third disc and tubular wall define a shot cup section adjacent to the shot cup extension section and proximate to the forward end of the tubular wall. The third disc is detachably connected to the tubular wall such that when the shotshell is fired, the third disc breaks away and travels rearward relative to the rest of the shotshell wad to a position adjacent to the second disc.

A plurality of fingers are defined by a plurality of lateral cuts through the tubular wall in the shot cup section extending from a point in the shot cup section to the forward end of the tubular wall. The tubular wall also includes a plurality of circumferential cuts passing therethrough substantially at the point where the plurality of lateral cuts terminate. The plurality of circumferential cuts extending through a section of each of the plurality of fingers. A plurality of lateral ridges extend inwardly from the tubular wall from substantially the point where the plurality of lateral cuts terminate to substantially the forward end of the tubular wall and are positioned at substantially the center of each of the plurality of fingers.

Preferably, the shotshell wad also includes a circumferential lip extending inwardly from the tubular wall in the shot cup extension section between the second disc and the third disc such that when the shotshell is fired, the third disc travels rearwardly past the lip and is trapped between the lip and the second disc. The shotshell wad preferably also includes a shot column distributor protruding from substantially the center of the third disc into the shot cup section. Also preferably, the tubular wall has a plurality of holes passing therethrough in the middle section.

Most preferably, the tubular wall, the first disc, the second disc, the third disc and the plurality of lateral ridges are integrally molded. When such is the case, the third disc preferably includes a plurality of circumferential perforations proximate to the tubular wall such that the third disc is detachably connected to the tubular wall. Also most preferably, the plurality of lateral cuts in the tubular wall are cut at an angle relative to a radius of the tubular wall at the point of each lateral cut.

The invention and its particular features and advantages will become more apparent from the following detailed description considered with reference to the accompanying drawings.

DETAILED DESCRIPTION OF THE INVENTION

Figure 1:
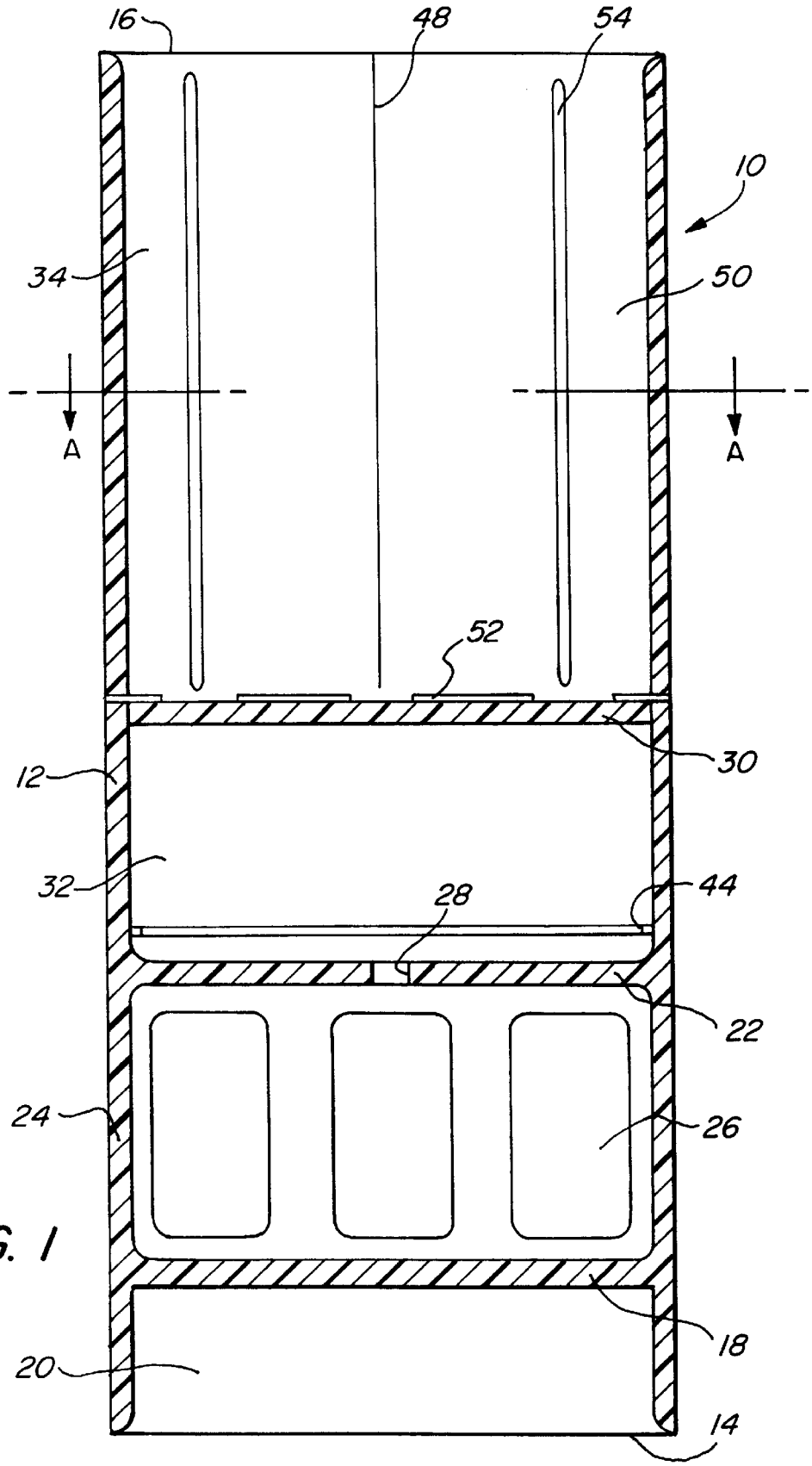
FIG. 1 is a longitudinal, partially cross-sectional view of a shotshell wad in accordance with the present invention.

Referring first to FIGS. 1–5, a shotshell wad 10 in accordance with the present invention is shown. The shotshell wad 10 includes a generally cylindrical tubular wall 12 having a rearward end 14 and a forward end 16. A first disc 18 is disposed within tubular wall 12 towards rearward end 14. Tubular wall 12 and first disc 18 define a gas seal section 20 of shotshell wad 10 proximate to rearward end 14 of tubular wall 12. Gas seal section 20 acts to trap the propulsive gases triggered by detonation of the powder charge when the shotgun is fired so that shotshell wad 10 is expelled from the barrel of the shotgun with great force.

A second disc 22 is disposed within tubular wall 12 between first disc 18 and forward end 16 of tubular wall 12. Tubular wall 12, first disc 18 and second disc 22 define a middle section 24 of shotshell wad 10 adjacent to gas seal section 20. Middle section 24 serves to maintain the desired height of the shot column in the shot case during loading, and preferably contains a plurality of holes 26 to reduce the amount of material required to produce shotshell wad 10 and to promote the flow of plastic into the mold when such a manufacturing process is used. Preferably second disc 22 includes a vent hole 28 at substantially its center. Vent hole 28 serves to facilitate manufacture of shotshell wad 10 by promoting the flow of plastic into the mold as well as to perform other functions during firing of the shotshell, as described fully below.

A third disc 30 is disposed within and detachably connected to tubular wall 12 between second disc 22 and forward end 16 of tubular wall 12. Tubular wall 12, second disc 22 and third disc 30 define a shot cup extension section 32 of shotshell wad 10 adjacent to middle section 24. Tubular wall 12 and third disc 30 define a shot cup section 34 adjacent to shot cup extension section 32 and proximate to forward end 16 of tubular wall 12. A shot column 36 is disposed within shot cup section 34, essentially filling shot cup section 34 to forward end 16.

Preferably, tubular wall 12, first disc 18, second disc 22 and third disc 30 are integrally molded as a single unit. When such is the case, the detachable connection between third disc 30 and tubular wall 12 is achieved by providing a plurality of perforations 38 (shown in FIG. 2) in third disc 30 proximate to tubular wall 12 after the molding process is complete.

When the shotgun is fired, detonation of the powder charge creates rapidly expanding gasses which strike gas seal section 20 of shotshell wad 10, causing a forward thrusting force (indicated by arrows 40). Forward thrusting force 40 causes shotshell wad 10 to begin moving forward. Since shotshell wad 10 is lighter than shot column 36, shotshell wad 10 overcomes inertial forces before shot column 36. Because of these inertial forces, shot column 36 exerts a relative rearward force on third disc 30, causing third disc 30 to detach, or break away, from tubular wall 12. Detached third disc 30 moves rearward (indicated by arrows 42) relative to the remainder of shotshell wad 10. As third disc 30 moves rearward, air in shot cup extension section 32 is compressed, escaping gradually through vent hole 28 and providing a cushioning effect. Instead of the wad suddenly striking the shot column, as is the case with prior art designs, this cushioning effect dissipates the force over a greater time, creating a strong push instead of a violent blow. This provides several advantages over the prior art. Because the contact between the wad and the shot column is cushioned, deformation of lead shot at the back of the column is greatly reduced or eliminated. As such, the number of flyers is also greatly reduced. With steel shot, the cushioning effect also reduces wear on the barrel, since the shot does not strike the walls of the barrel with the great force which occurs with prior art designs. A further advantage relates to the recoil felt by the shooter. Because, in known wad designs, the shot cup floor hits the shot column with a tremendous force, the recoil felt by the shooter is a sudden, sharp blow. The cushioning effect created by the detachable third disc 30 also acts to cushion this recoil felt by the shooter.

Detached third disc 30 travels rearward in shot cup extension section 32 past a circumferential lip 44, which extends inwardly from tubular wall 12 in shot cup extension section 32, to a position adjacent to second disc 22. Circumferential lip 44 extends inward for a distance such that third disc 30 must deform to travel past. Thus, third disc 30 is trapped between second disc 22 and circumferential lip 44. Preferably, circumferential lip 44 is integrally molded with tubular wall 12, first disc 18, second disc 22 and third disc 30 as a single unit.

Shot column 36 travels rearward (indicated by arrows 46) along with third disc 30. As such, shot column 36 no longer extends to forward end 16, but rather is set back a distance from forward end 16 essentially equal to the distance third disc 30 travels rearward in shot cup extension section 32. This set back of shot column 36 inhibits shot from escaping from shot cup section 34 as shotshell wad 10 travels up the barrel of the shotgun, thus alleviating the problem of escaped shot coming in direct contact with the inside of the barrel. This reduces wear on the barrel when any type shot is used, as well as coating of the interior of the barrel with lead when lead shot is used. This also avoids the problem of friction being generated between the shot and the barrel, which can cause the shot to lose velocity.

Figure 2:
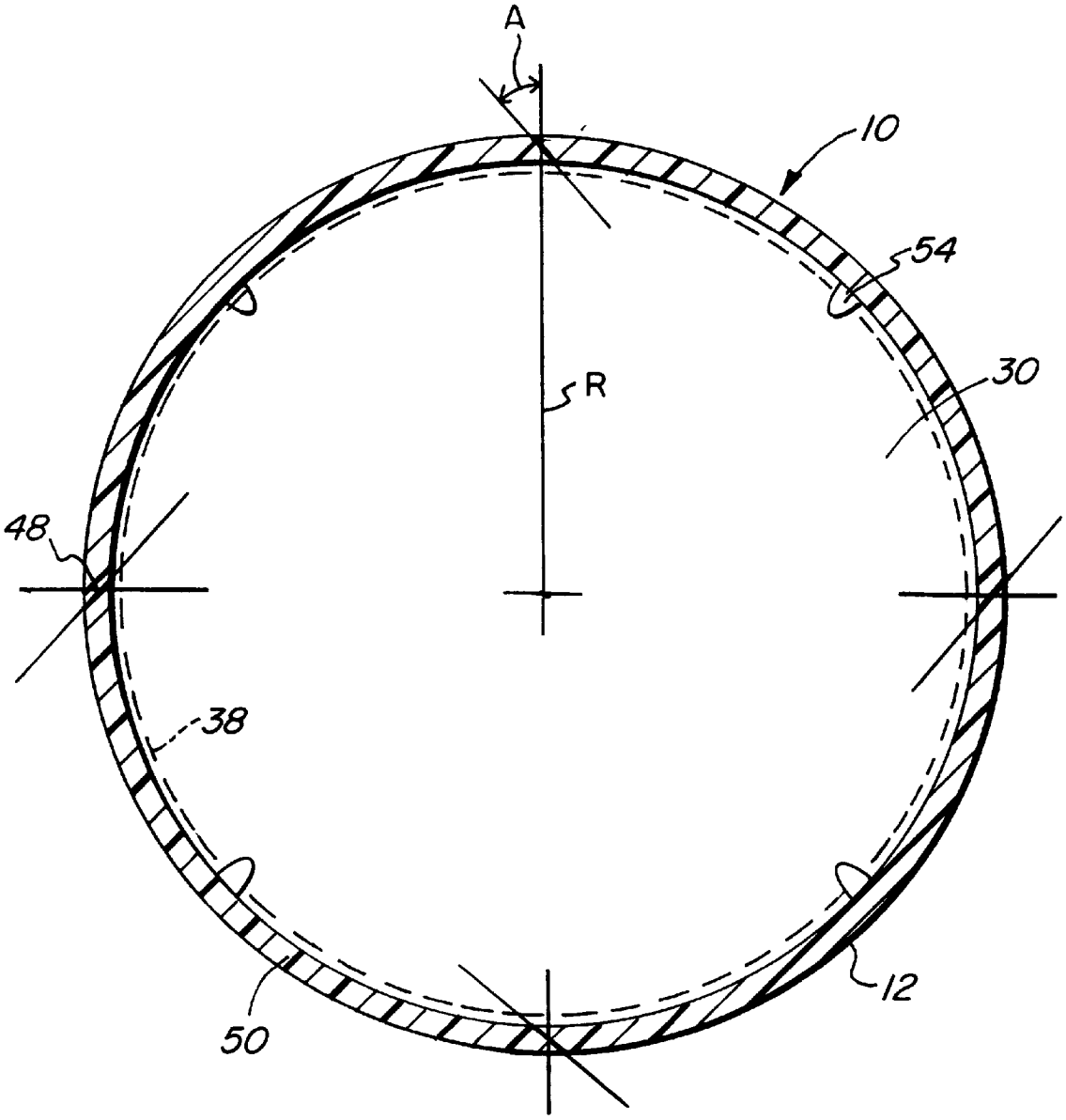
FIG. 2 is a lateral, partially cross-sectional view of the shotshell wad shown in FIG. 1 taken along the line A—A of FIG. 1.
Figure 3:
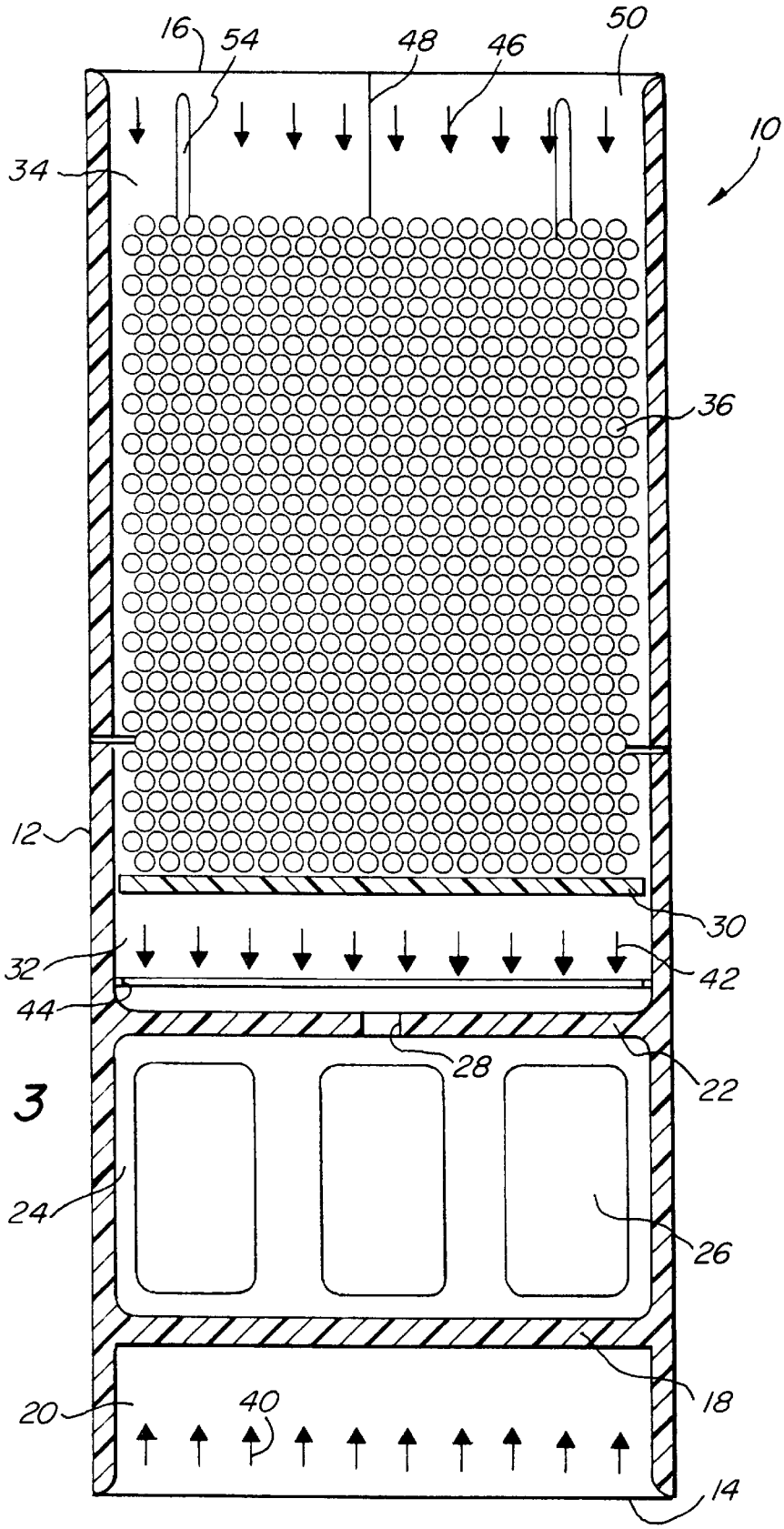
FIG. 3 is a longitudinal, partially cross-sectional view of the shotshell wad shown in FIG. 1 shown immediately after the shotgun has been fired and the detachable shot cup floor has broken away.

Tubular wall 12 includes a plurality of lateral cuts 48 in shot cup section 34, which define a plurality of fingers 50. Preferably, lateral cuts 48 are introduced after initial molding of shotshell wad 10. Four fingers 50 are preferable, although more or less may be provided. Lateral cuts 48 pass all the way through tubular wall 12 and preferably extend from a point substantially adjacent third disc 30 to forward end 16. As best seen in FIG. 2, lateral cuts 48 are preferably cut at an angle A relative to a radius R of tubular wall 12 at the point of each lateral cut 48. Angle A is preferably 45 degrees, although a wide range of angles may be used.

Figure 4:
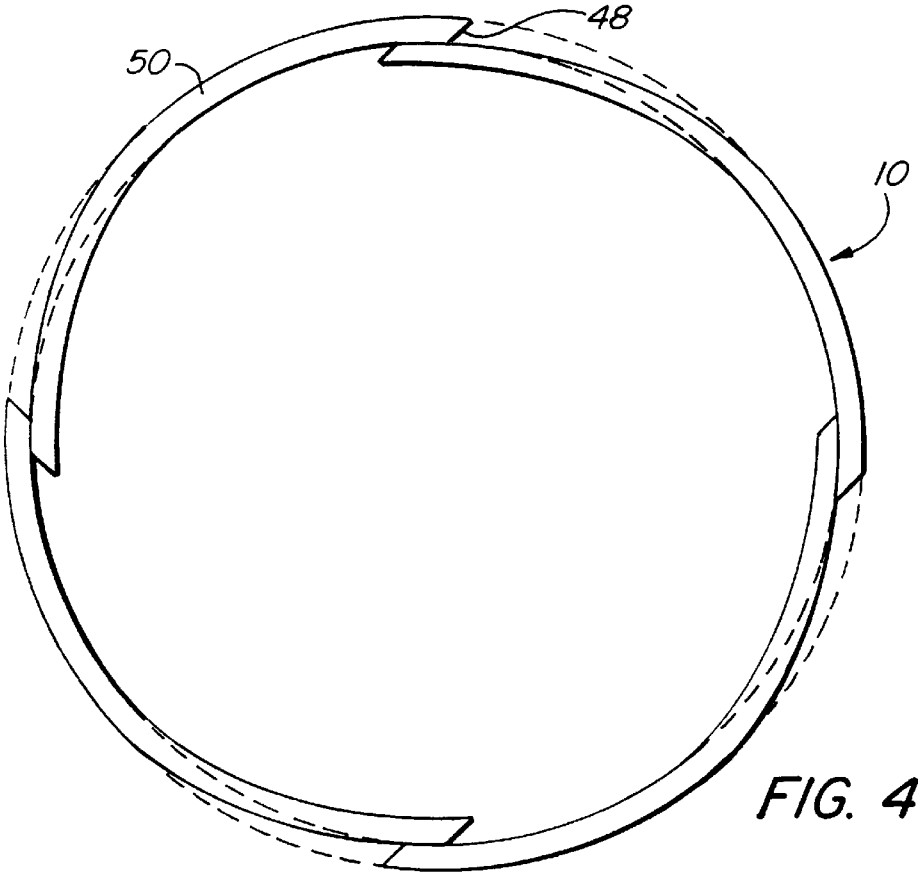
FIG. 4 is a lateral end view of the shotshell wad shown in FIG. 1 with the orientation of the fingers shown as the shotshell wad is constricted traveling up the barrel of the shotgun and with the initial orientation of the fingers shown in phantom.

As it travels up the increasingly constricted barrel of the shotgun, shotshell wad 10 is compressed. As best seen in FIG. 4, fingers 50 become displaced from their original positions (shown in phantom). Because lateral cuts 48 are cut at an angle A, mating surfaces between the fingers at each lateral cut slide relative to each other and deform substantially uniformly to the positions shown in FIG. 4. If lateral cuts 48 were not cut at an angle A, non-uniform deformation of fingers 50 could occur, possibly resulting in undesirable shot patterns.

Tubular wall 12 also includes a plurality of circumferential cuts 52 passing therethrough at substantially the point adjacent third disc 30 where lateral cuts 48 terminate. Preferably, circumferential cuts 52 are introduced after initial molding of shotshell wad 10. Circumferential cuts 52 extend through a portion of each finger 50, leaving each finger 50 attached to the remainder of shotshell wad 10 at substantially the center thereof. Extending inwardly from tubular wall 12 at substantially the center of each finger 50 are a plurality of lateral ridges 54, which act to strengthen fingers 50. Lateral ridges 54 extend from substantially the point adjacent third disc 30 where lateral cuts 48 terminate to substantially forward end 16. Preferably, lateral ridges 54 are integrally molded with the remainder of shotshell wad 10 as a single unit.

Figure 5:
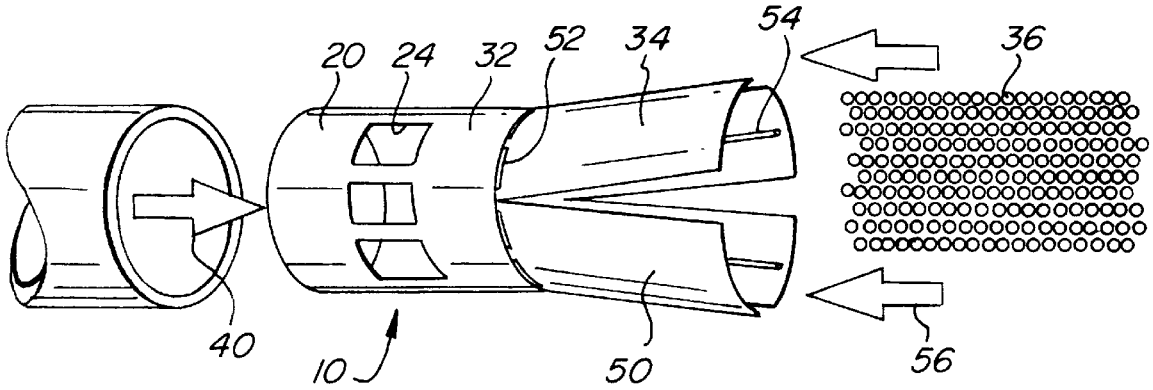
FIG. 5 is a perspective view of the shotshell wad shown in FIG. 1 exiting the barrel of a shotgun with the fingers beginning to peel back and a shot column exiting the shotshell wad.

As shotshell wad 10 exits the barrel of the shotgun at a high velocity, air drag (indicated by arrows 56 in FIG. 5) acts to peel fingers 50 rearward. FIG. 5 illustrates fingers 50 beginning to peel back. Circumferential cuts 52 facilitate the rapid peeling back of fingers 50 to a position substantially perpendicular to the remainder of shotshell wad 10, thereby greatly increasing air drag 56 on shotshell wad 10. Circumferential cuts 52 also promote uniform peeling back of each finger 50, so that shotshell wad 10 does not spin out of control, thereby interfering with shot column 36 as it exits shotshell wad 10. Lateral ridges 54 act to strengthen fingers 50 to inhibit bending of fingers 50, except at the point of circumferential cuts 52. Thus, shot column 36 is rapidly separated from shotshell wad 10 such that shotshell wad 10 does not interfere with the shot pattern and such that shotshell wad 10 does not spin out of control, interfering with shot proximate to, or even still contained within, shotshell wad 10. The result is that approximately ninety percent of the shot is delivered on target in a useful pattern, instead of the only two-thirds achieved with prior art designs.

Figure 6:
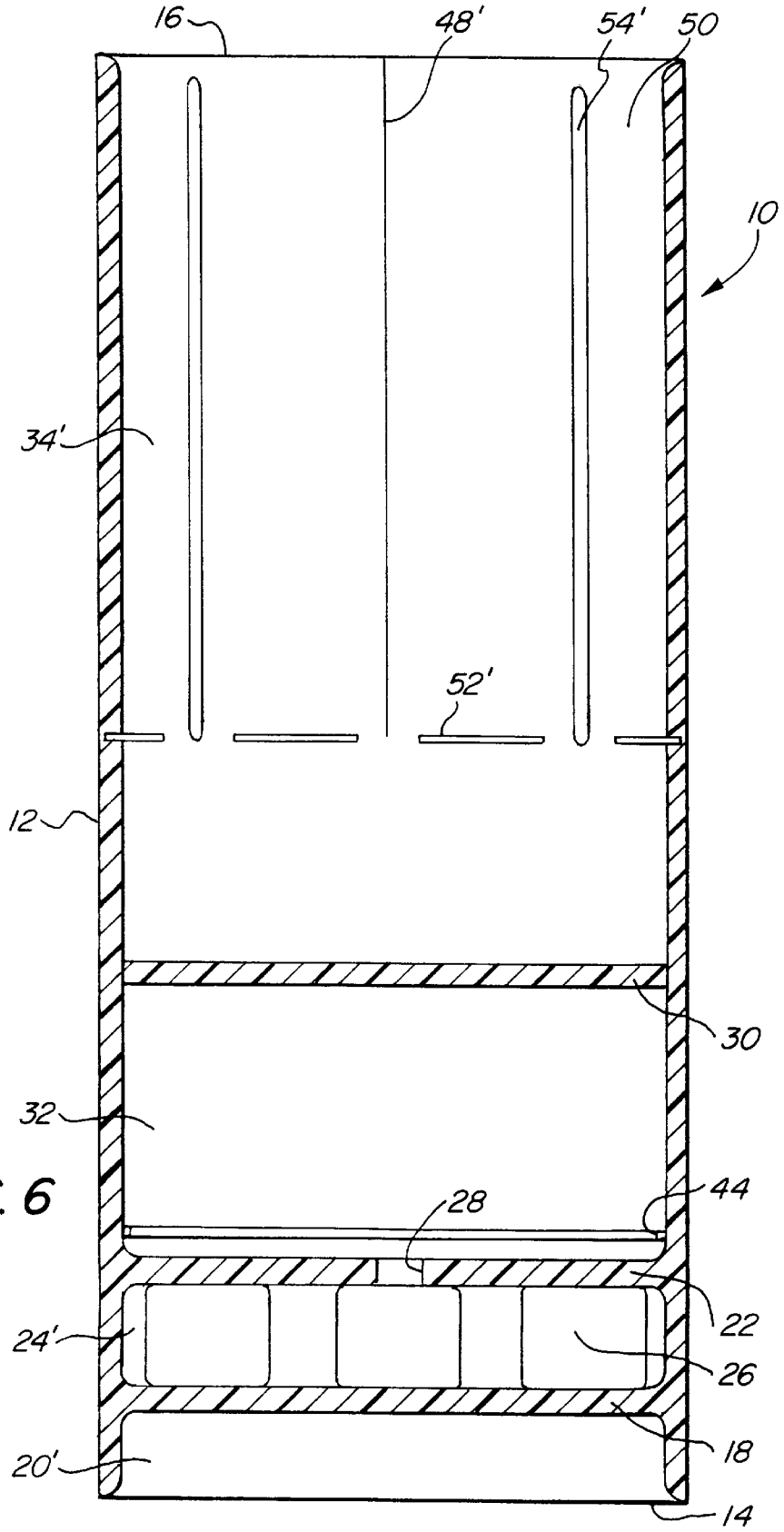
FIG. 6 is a longitudinal, partially cross-sectional view of a shotshell wad in accordance with a second embodiment of the present invention which is adapted to accommodate shot lighter than lead, such as steel, tungsten and bismuth shot.

Referring now to FIG. 6, a second embodiment of the shotshell wad 10 in accordance with the present invention is shown. This embodiment is adapted for use with shot other than lead, such as steel, tungsten or bismuth. Because this shot is lighter than lead, more shot is necessary to achieve a shotshell with a given weight. As such, shot cup section 34' is elongated, with the lengths of gas seal section 20' and middle section 24' being correspondingly diminished. Instead of lateral cuts 48' terminating at a point proximate to third disc 30, lateral cuts 48' terminate at a point in shot cup section 34' forward of third disc 30. This is done to provide extra strength at the rear of the now elongated shot cup section 34'. The location of circumferential cuts 52' and the termination point of lateral ridges 54' are also based on this point where lateral cuts 48' terminate.

Figure 7:
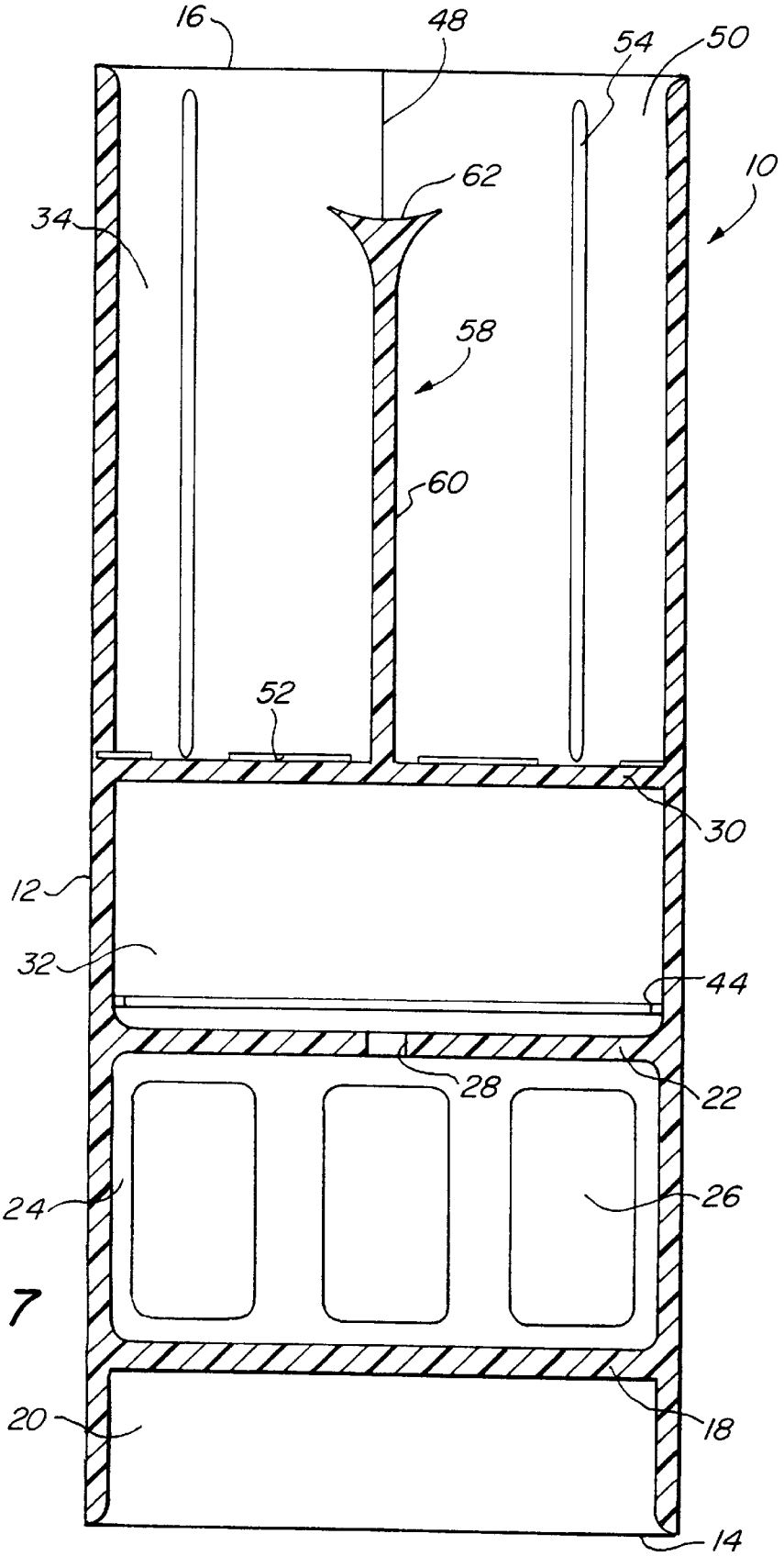
FIG. 7 is a longitudinal, partially cross-sectional view of a shotshell wad in accordance with a third embodiment of the present invention which include shot column distributor.
Figure 8:
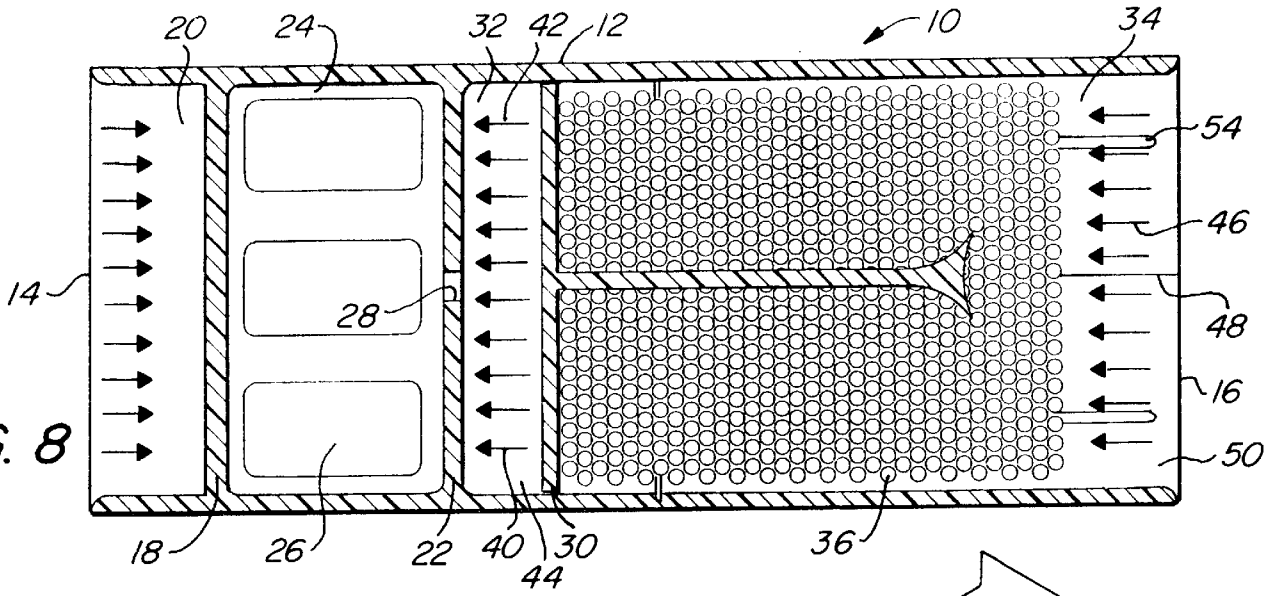
FIG. 8 is a longitudinal, partially cross-sectional view of the shotshell wad shown in FIG. 7 shown immediately after the shotgun has been fired and the detachable shot cup floor has broken away; and, FIG. 9 is a longitudinal, partially cross-sectional view of the shot column distributor and detachable floor of the shotshell wad shown in FIG. 7 illustrating the function of the shot column distributor.
Figure 9:
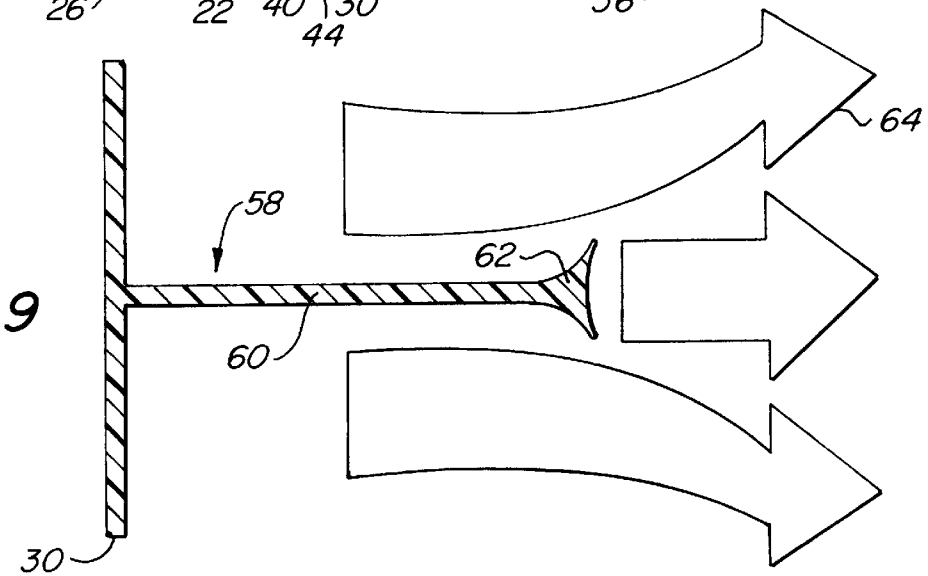

Referring now to FIGS. 7–9, another embodiment of the shotshell wad 10 in accordance with the present invention is shown. In this embodiment shotshell wad 10 further includes a shot column distributor 58, which extends forward from third disc 30 into shot cup section 34, and which includes a generally cylindrical body portion 60 and a head portion 62. Head portion 62 flares out from body portion 60, and acts to spread shot column 36 as shotshell wad 10 exits the barrel of the shotgun (shown in FIG. 9 as arrows 64). By varying the degree of flair and the diameter of head portion 62, it is possible to achieve shot patterns equivalent to the different shotgun chokes. Preferably, shot column distributor 58 is integrally molded with the remainder of shotshell wad 10 as a single unit.

The present invention, therefore, provides a shotshell wad which results in few flyers, which reduces damage to the chamber of the barrel upon firing, which reduces the recoil felt by the shooter upon firing, which inhibits the shot from escaping the shot cup and directly contacting the inside of the barrel, which is quickly separated from the shot upon exiting the barrel, and which delivers the shot charge on target in a useful pattern.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A shotshell wad for use in a shotgun shell comprising:

a generally cylindrical tubular wall having a rearward end and a forward end;

a first disc disposed within and attached to said tubular wall, said first disc and said tubular wall defining a gas seal section proximate to the rearward end of said tubular wall;

a second disc disposed within and attached to said tubular wall between said first disc and the forward end of said tubular wall, said second disc, said first disc, and said tubular wall defining a middle section adjacent to the gas seal section, said second disc having a vent hole passing therethrough; and, a third disc disposed within and detachably connected to said tubular wall between said second disc and the forward end of said tubular wall, said third disc, said second disc, and said tubular wall defining a shot cup extension section adjacent to the middle section and said third disc and said tubular wall defining a shot cup section adjacent to the shot cup extension section and proximate to the forward end of said tubular wall, said third disc detachably connected to said tubular wall such that when the shotshell is fired, said third disc breaks away and travels rearward relative to said tubular wall, said first disc and said second disc to a position adjacent to said second disc.

2. The shotshell wad of claim 1 further comprising a circumferential lip extending inwardly from said tubular wall in the shot cup extension section between said second disc and said third disc such that when the shotshell is fired, said third disc travels rearwardly past said lip and is trapped between said lip and said second disc.

3. The shotshell wad of claim 1 wherein said tubular wall has a plurality of holes passing therethrough in the middle section.

4. The shotshell wad of claim 1 further comprising a shot column distributor protruding from substantially the center of said third disc into the shot cup section, said shot column distributor having a stem portion and a head portion.

5. The shotshell wad of claim 1 wherein said tubular wall, said first disc, said second disc and said third disc are integrally molded.

6. The shotshell wad of claim 5 wherein said third disc includes a plurality of circumferential perforations proximate to said tubular wall such that said third disc is detachably connected to said tubular wall.

7. The shotshell wad of claim 1 wherein said tubular wall includes a plurality of lateral cuts therethrough in the shot cup section extending from a point in the shot cup section to the forward end of said tubular wall, the plurality of lateral cuts in said tubular wall defining a plurality of fingers.

8. The shotshell wad of claim 7 wherein the plurality of lateral cuts in said tubular wall are cut at an angle relative to a radius of said tubular wall at each of the plurality of lateral cuts.

9. The shotshell wad of claim 7 wherein said tubular wall includes a plurality of circumferential cuts passing therethrough substantially at the point where the plurality of lateral cuts terminate, the plurality of circumferential cuts extending through a portion of each of the plurality of fingers.

10. A shotshell wad for use in a shotgun shell comprising:

a generally cylindrical tubular wall having a rearward end and a forward end;

a first disc disposed within and attached to said tubular wall, said first disc and said tubular wall defining a gas seal section proximate to the rearward end of said tubular wall;

a second disc disposed within and attached to said tubular wall between said first disc and the forward end of said tubular wall, said second disc, said first disc, and said tubular wall defining a middle section adjacent to the gas seal section, and said second disc and said tubular wall defining a shot cup section adjacent to the middle section and proximate to the forward end of said tubular wall;

a plurality of fingers defined by a plurality of lateral cuts through said tubular wall in the shot cup section extending from a point in the shot cup section spaced from said second disc to the forward end of said tubular wall, said tubular wall also including a plurality of circumferential cuts passing therethrough substantially at the point where the plurality of lateral cuts terminate, the plurality of circumferential cuts extending through a portion of each of the plurality of fingers; and, a plurality of lateral ridges extending inwardly from said tubular wall, each of the plurality of lateral ridges extending from substantially the point where the plurality of lateral cuts terminate to substantially the forward end of said tubular wall and being positioned at substantially the center of each of the plurality of fingers.

11. The shotshell wad of claim 9 wherein the plurality of lateral cuts in said tubular wall are cut at an angle relative to a radius of said tubular wall at each of the plurality of lateral cuts.

12. The shotshell wad of claim 9 wherein said tubular wall, said first disc, said second disc and said plurality of lateral ridges are integrally molded.

13. The shotshell wad of claim 9 wherein said tubular wall has a plurality of holes passing therethrough in the middle section.

14. A shotshell wad for use in a shotgun shell comprising:

a generally cylindrical tubular wall having a rearward end and a forward end;

a first disc disposed within and attached to said tubular wall, said first disc and said tubular wall defining a gas seal section proximate to the rearward end of said tubular wall;

a second disc disposed within and attached to said tubular wall between said first disc and the forward end of said tubular wall, said second disc, said first disc, and said tubular wall defining a middle section adjacent to the gas seal section, said second disc having a vent hole passing therethrough;

a third disc disposed within and detachably connected to said tubular wall between said second disc and the forward end of said tubular wall, said third disc, said second disc, and said tubular wall defining a shot cup extension section adjacent to the middle section and said third disc and said tubular wall defining a shot cup section adjacent to the shot cup extension section and proximate to the forward end of said tubular wall, said third disc detachably connected to said tubular wall such that when the shotshell is fired, said third disc breaks away and travels rearward relative to said tubular wall, said first disc and said second disc to a position adjacent to said second disc;

a plurality of fingers defined by a plurality of lateral cuts through said tubular wall in the shot cup section extending from a point in the shot cup section to the forward end of said tubular wall, said tubular wall also including a plurality of circumferential cuts passing therethrough substantially at the point where the plurality of lateral cuts terminate, the plurality of circumferential cuts extending through a portion of each of the plurality of fingers; and, a plurality of lateral ridges extending inwardly from said tubular wall, each of the plurality of lateral ridges extending from substantially the point where the plurality of lateral cuts terminate to substantially the forward end of said tubular wall and being positioned at substantially the center of each of the plurality of fingers.

15. The shotshell wad of claim 14 further comprising a circumferential lip extending inwardly from said tubular wall in the shot cup extension section between said second disc and said third disc such that when the shotshell is fired, said third disc travels rearwardly past said lip and is trapped between said lip and said second disc.

16. The shotshell wad of claim 14 wherein said tubular wall has a plurality of holes passing therethrough in the middle section.

17. The shotshell wad of claim 14 further comprising a shot column distributor protruding from substantially the center of said third disc into the shot cup section, said shot column distributor having a stem portion and a head portion.

18. The shotshell wad of claim 14 wherein said tubular wall, said first disc, said second disc, said third disc and said plurality of lateral ridges are integrally molded.

19. The shotshell wad of claim 18 wherein said third disc includes a plurality of circumferential perforations proximate to said tubular wall such that said third disc is detachably connected to said tubular wall.

20. The shotshell wad of claim 14 wherein the plurality of lateral cuts in said tubular wall are cut at an angle relative to a radius of said tubular wall at each of the plurality of lateral cuts.

* * * * *